US010450881B2

(12) United States Patent
Mugglestone

(10) Patent No.: US 10,450,881 B2
(45) Date of Patent: Oct. 22, 2019

(54) TURBINE ASSEMBLY AND CORRESPONDING METHOD OF OPERATION

(71) Applicant: Siemens Aktiengesellschaft, Munich (DE)

(72) Inventor: Jonathan Mugglestone, Brinsley (GB)

(73) Assignee: Siemens Aktiengesellschaft, Munich (DE)

( * ) Notice: Subject to any disclaimer, the term of this patent is extended or adjusted under 35 U.S.C. 154(b) by 392 days.

(21) Appl. No.: 15/305,235

(22) PCT Filed: Apr. 15, 2015

(86) PCT No.: PCT/EP2015/058214
§ 371 (c)(1),
(2) Date: Oct. 19, 2016

(87) PCT Pub. No.: WO2015/169555
PCT Pub. Date: Nov. 12, 2015

(65) Prior Publication Data

US 2017/0044915 A1 Feb. 16, 2017

(30) Foreign Application Priority Data

May 8, 2014 (EP) ..... 14167557

(51) Int. Cl.
*F01D 9/06* (2006.01)
*F01D 25/12* (2006.01)

(52) U.S. Cl.
CPC ..... *F01D 9/065* (2013.01); *F01D 25/12* (2013.01); *F05D 2220/32* (2013.01); *F05D 2260/201* (2013.01); *F05D 2260/202* (2013.01)

(58) Field of Classification Search
CPC .... F01D 9/065; F01D 9/041; F01D 5/08–084; F01D 5/189
See application file for complete search history.

(56) References Cited

U.S. PATENT DOCUMENTS 4,079,587 A * 3/1978 Nordstrom ..... F01D 9/065 415/115
4,288,201 A 9/1981 Wilson
(Continued)

FOREIGN PATENT DOCUMENTS

CN 101122243 A 2/2008
EP 1191189 A1 3/2002
(Continued)

OTHER PUBLICATIONS

International Search Report dated Jul. 23, 2015, for PCT application No. PCT/EP2015/058214.
(Continued)

*Primary Examiner* — Richard A Edgar
*Assistant Examiner* — Topaz L. Elliott
(74) *Attorney, Agent, or Firm* — Beusse Wolter Sanks & Maire

(57) ABSTRACT

A turbine assembly having a basically hollow aerofoil with at least one cavity spanning the aerofoil in span wise direction of the aerofoil, an outer platform and an inner platform, each comprising at least one cavity, which are in flow communication with each other over at least one jumper tube, which extends in span wise direction along a whole length of the cavity of the aerofoil, and with a sealed gap being arranged between an outer surface of the jumper tube and an inner surface of a cavity wall of the aerofoil. A corresponding method operates a turbine assembly.

19 Claims, 6 Drawing Sheets

(56) References Cited

U.S. PATENT DOCUMENTS 5,020,318 A * 6/1991 Vdoviak ..... F01D 9/065 60/226.1
5,488,825 A * 2/1996 Davis ..... F01D 5/187 415/115
5,630,700 A 5/1997 Olsen et al.
6,217,279 B1 * 4/2001 Ai ..... F01D 9/065 415/110
6,874,988 B2 * 4/2005 Tiemann ..... F01D 5/189 415/115
7,007,488 B2 * 3/2006 Orlando ..... F01D 9/065 60/782
7,011,492 B2 * 3/2006 Schwartz ..... F01D 5/189 415/115
7,070,386 B2 * 7/2006 Kessler ..... F01D 5/189 415/115
7,527,470 B2 * 5/2009 Guimbard ..... F01D 5/189 415/115
7,658,591 B2 * 2/2010 Dervaux ..... F01D 5/189 415/115
7,819,628 B2 * 10/2010 Dervaux ..... F01D 5/18 415/115
7,909,573 B2 * 3/2011 Cameriano ..... F01D 9/065 415/134
8,353,668 B2 * 1/2013 Propheter-Hinckley ..... F01D 9/065 415/115
8,408,866 B2 * 4/2013 Weaver ..... F01D 5/082 415/1
9,726,024 B2 * 8/2017 Buhler ..... F01D 9/02
2004/0022630 A1 2/2004 Tiemann
2006/0093470 A1 5/2006 Bermond et al.
2007/0231150 A1 10/2007 Dervaux et al.
2010/0054915 A1 * 3/2010 Devore ..... F01D 5/189 415/116
2013/0315725 A1 11/2013 Uechi et al.
2014/0205447 A1 * 7/2014 Patat ..... F01D 9/065 415/177
2015/0233295 A1 * 8/2015 Farah ..... F02C 7/18 60/772
2015/0345400 A1 * 12/2015 Scott ..... F01D 9/065 60/796
2015/0354382 A1 * 12/2015 Pakkala ..... F01D 9/065 60/806
2017/0204734 A1 * 7/2017 Groves, II ..... F01D 9/065
2017/0292455 A1 * 10/2017 VanTassel ..... F01D 25/24
2018/0209300 A1 * 7/2018 Johnson ..... F01D 9/065

FOREIGN PATENT DOCUMENTS

EP 1659265 A1 5/2006
FR 1325291 A * 4/1963 ..... F01D 9/065
FR 1351268 A 1/1964
WO 2012019975 A1 2/2012

OTHER PUBLICATIONS

EP Search Report dated Sep. 4, 2014, for EP application No. 14167557.9.
CN Office Action dated Jun. 1, 2017, for CN patent application No. 201580023883.0.

* cited by examiner

TURBINE ASSEMBLY AND CORRESPONDING METHOD OF OPERATION

CROSS REFERENCE TO RELATED APPLICATIONS

This application is the US National Stage of International Application No. PCT/EP2015/058214 filed Apr. 15, 2015, and claims the benefit thereof. The International Application claims the benefit of European Application No. EP14167557 filed May 8, 2014. All of the applications are incorporated by reference herein in their entirety.

FIELD OF INVENTION

The present invention relates to a method for cooling at least a part of a turbine assembly with a cooling medium. The present invention further relates to an aerofoil-shaped turbine assembly such as turbine rotor blades and stator vanes, and to jumper tubes used in such components to aid the cooling and sealing system.

BACKGROUND TO THE INVENTION

Modern turbines often operate at extremely high temperatures. The effect of temperature on the turbine blades, stator vanes and surrounding components can be detrimental to the efficient operation of the turbine and can, in extreme circumstances, lead to distortion and possible failure of such components. In order to overcome this risk, high temperature turbines may include hollow blades or vanes incorporating so-called jumper tubes to aid the cooling and sealing flow systems by minimising the heat pickup within these flows, which can be especially critical for a disc region of the aerofoil assembly.

These so-called jumper tubes are hollow tubes that run radially within the blades or vanes. Air is forced into and along these tubes. The design intent is to minimise the heat pick up of the flow as it passes through the tube. To prevent heat transfer from the jumper tube to the aerofoil the jumper tube is arranged with an air gap in respect to an aerofoil cavity wall. The air gap creates an insulating layer of relatively low thermal conductivity. Heat transfer across the air gap is largely by radiation.

By operation with high flow rates through the jumper tube this design works very well. However, problems arise for low flow rates through the jumper tube causing high heat pickup of the cooling stream. When this temperature rise becomes excessive, the integrity of the disc cooling system can be significantly affected, and an excess cooling is required to compensate.

It is a first objective of the present invention to provide a method for cooling at least a part, especially a disc region, of a turbine assembly with a cooling medium with which the above-mentioned shortcomings can be mitigated, and especially a more aerodynamic efficient aerofoil and gas turbine component is facilitated.

It is a second objective of the invention to provide an advantageous aerofoil-shaped turbine assembly such as a turbine rotor blade and a stator vane. A third objective of the invention is to provide an advantageous jumper tube used in such an assembly for cooling purposes.

SUMMARY OF THE INVENTION

Accordingly, the present invention provides a method for cooling at least a part, especially a disc region, of a turbine assembly with a cooling medium, wherein the turbine assembly comprises a basically hollow aerofoil with at least one cavity spanning the aerofoil in span wise direction of the aerofoil, an outer platform and an inner platform, each comprising at least one cavity, which are in flow communication with each other over at least one jumper tube, which extends in span wise direction along a whole length of the cavity of the aerofoil, and with a basically sealed gap being arranged between an outer surface of the jumper tube and an inner surface of a cavity wall of the aerofoil.

It is provided that a fraction of the cooling medium exits the jumper tube directly adjacent to the outer platform and enters the gap between the jumper tube and the cavity wall of the aerofoil, wherein the cooling medium travels along the gap in span wise direction basically unhindered and straight and wherein the cooling medium exits the gap directly adjacent to and/or at the inner platform.

Due to the inventive method an excessive heat pickup in comparison with a standard design of the jumper tube especially by low jumper tube flow rates can be avoided. The invention is a simple modification to the standard design, thus saving costs and construction efforts. Further, an existing design may be retrofitted easily. Although some cooling flow is used to buffer the air gap cavity, the amount is only a fraction of that required to reduce the heat pickup of the standard design when excessive flow through the jumper tube is used to compensate.

Even if a term like aerofoil, platform, cavity, jumper tube, gap, wall segment or aperture is used in the singular or in a specific numeral form in the claims and the specification the scope of the patent (application) should not be restricted to the singular or the specific numeral form. It should also lie in the scope of the invention to have more than one or a plurality of the above mentioned structure(s).

A turbine assembly is intended to mean an assembly provided for a turbine engine, like a gas turbine, wherein the assembly possesses at least an aerofoil. Advantageously, the turbine assembly has a turbine wheel or a turbine cascade with circumferential arranged aerofoils and an outer and an inner platform arranged at opponent ends of the aerofoil(s). The part of the turbine assembly to be cooled may be any part arranged in radial direction between the aerofoil and an axis of the turbine engine and is advantageously a disc. In case of a turbine wheel several aerofoils are connected with one another by a disc. Such a disc and the surrounding disc region are intended to be cooled by the turbine assembly.

In case of a turbine wheel the disc region is cooled by aerofoils of the turbine wheel. In case of a turbine cascade, in turn, the disc region of the upstream and downstream arranged turbine wheels are cooled, wherein the terms upstream and downstream refer to a flow direction of an airflow and/or working gas flow through the turbine engine. Thus, a turbine assembly may comprise two aerofoils with platforms, wherein the aerofoils are arranged in flow direction of the working gas one after the other, one being an aerofoil of a turbine cascade (turbine vane) and the other an aerofoil of a turbine wheel (turbine blade).

In this context a "basically hollow aerofoil" means an aerofoil with a casing, wherein the casing encases at least one cavity. A structure, like a rip, which divides different cavities in the aerofoil from one another and for example extends in a span wise direction of the aerofoil, does not hinder the definition of "a basically hollow aerofoil". Advantageously, the aerofoil is hollow. In particular, the basically hollow aerofoil, referred as aerofoil in the following description, has two cooling regions, a jumper cooling region at a leading edge of the aerofoil and a state of the art pin-fin/pedestal cooling region at the trailing edge. These regions could be separated from one another through a rip.

Each platform advantageously comprises at least one wall segment being arranged basically perpendicular to the span wise direction of the aerofoil, wherein the wall segments of the platforms are arranged at opposite ends of the aerofoil and basically in parallel towards each other. A wall segment is intended to mean a region of the turbine assembly which confines at least a part of a cavity and in particular, a cavity of the aerofoil. Moreover, the wall segment comprises an aperture that provides access to the cavity of the aerofoil and may partially cover this cavity. Further, the inserted jumper tube may at least span a part of the aperture in span wise direction.

In the scope of an arrangement of the wall segment as "basically perpendicular" to a span wise direction should also lie a divergence of the wall segment in respect to the span wise direction of about 30°. Advantageously, the wall segment is arranged perpendicular to the span wise direction. Moreover, a "basically parallel arrangement" is intended to mean a divergence of the arrangement of the wall segments in respect to each other of about 30° from their strictly parallel arrangement. A span wise direction of the aerofoil is defined as a direction extending basically perpendicular, advantageously perpendicular, to a direction from the leading edge to the trailing edge of the aerofoil.

In this context a cavity of the platform is intended to mean an at least at two, advantageously four sides enclosed space that is radially encased at at least one radial side from the platform or its wall segment. An opposed radial side may for example be restricted by a casing, like a casing of the turbine engine in which the turbine assembly is mounted. A flow communication through slots or apertures in the side wall, the casing or between them should not hinder the meaning of enclosed or encased.

In this context a jumper tube is intended to mean a hollow structure, like a tubular tube, that primary function is to connect the cavities of the platforms and to bridge the span of the aerofoil, to provide a passage for the cooling medium to flow with minimal heat pickup. Although not its prime function, it can be used to provide a cooling of the aerofoil itself. Thus, the jumper tube is no impingement tube, which has the primary function to cool walls of the cavity of the aerofoil housing the impingement tube by jets of cooling medium exiting a plurality of holes and impinging at the cavity wall.

A jumper tube in comparison with an impingement tube has or is likely to have: —A greater portion of the air entering the jumper tube passing through its end. However, the through flow can vary significantly depending upon the system requirements. —A smaller total aperture/hole area in the surface (wall) of the jumper tube. —The cross section at the ends of the jumper tube is significantly larger than the aperture/hole area in the surface (wall). By specifically designing the inlet and exit areas in such a way pressure drops can be minimised. —A lower or minimal number of apertures/holes. —The locations of the apertures/holes are different, basically, not—homogenously—distributed along a span wise length and/or a contour/circumference of the jumper tube. —A greater distance between the tube and the aerofoil wall is likely. —Not following a contour of the aerofoil, not likely a fairly constant gap between the jumper tube and aerofoil cavity wall. —Contour independent of the aerofoil contour (i.e circular)—Cooling medium would leave the jumper tube at a smaller radius compared to where it entered in relation to the centreline/axis of the gas turbine engine. In other words, the span wise length travelled by the cooling air is greater.

A "basically sealed gap" is intended to means a space being to at least 90%, advantageously to at least 95% and most advantageously to at least 98% sealed in respect to its environment. Thus, apertures or slots allowing a flow communication with the environment surrounding the gap should not hinder the definition of the gap as sealed. The gap is enclosed by at least the outer surface of the jumper tube and the inner surface of the cavity wall of the aerofoil and advantageously radially by sections of the wall segments of the platforms.

The fraction of the cooling medium that exits the jumper tube is a minor fraction and/or less than 10% of the cooling medium entering the jumper tube from the cavity of the outer platform. The purpose of the cooling medium traveling the gap is to vent away the radiative heat transfer or rather heat flux. The needed amount of cooling medium entering and traveling the gap will for example depend on the used methods of the aerofoil and/or the jumper tube. Thus, the heat flux may e.g. occur between two metal surfaces or a metal and a ceramic surface. In case of a ceramic surface and the low thermal conductivity of a ceramic would significantly lower the need for the purge flow and would for example be less than 2%. Thus, the gap provides a by-pass for cooling medium in respect to the main cooling flow along the jumper tube. The main flow of cooling medium is intended for cooling of the disc region and surrounding regions.

The phrasing "directly adjacent" should be understood as in near proximity and/or for the exit through the jumper tube as "at a radial beginning of the gap" and for the exit from the gap through the or at the inner platform "as at a radial end of the gap". Moreover, the exits occur directly adjacent to the wall segments of the outer and the inner platform, respectively. Furthermore, the flow of cooling medium exits the gap into the gas path and especially away from the disc to be cooled.

In this context "basically unhindered and straight" should be understood as undisturbed or straight forward in radial direction and/or as not creating unnecessary and/or exuberant pressure drops, wherein a flow of the cooling medium around the jumper tube, e.g. in circumferential direction, and/or minor turbulences e.g. caused by collision with walls of the gap or irregularities of the walls, should not hinder the embodiment as unhindered and straight.

Advantageously, the aerofoil comprises a single cavity. But the invention could also be realized for an aerofoil comprising two or more cavities e.g. each of them accommodating at least one jumper tube and/or being a cavity as a part of the fin-pin/pedestal cooling region.

Advantageously, a cooling flow of the cooling medium flowing in span wise direction along the gap provides an insulation for the jumper tube to prevent a heat transfer between the jumper tube and the cavity wall of the aerofoil. Hence, heat pickup of the jumper tube flow can be minimised by using a buffer layer of cooling air to shield the jumper tube effectively. The temperature rise of the jumper tube flow can be adjusted by varying the amount of flow through the buffer cavity.

In a further advantageous embodiment at least 80% advantageously at least 90% and most advantageously at least 95% of a span wise length of the gap are travelled by the cooling medium. This ensures a proper insulation of the aerofoil or its casing from the jumper tube. The metal temperature of the aerofoil may vary along the span wise length and the higher the temperature the more important the insulation effect. Hence, a proper insulation effect advantageously along the whole span wise length will be most beneficial.

Advantageously, the jumper tube is arranged in the cavity of the aerofoil in such a way that the cooling medium flows unhindered in the gap all around an outer contour of the jumper tube. In other words, the gap extends around the jumper tube, advantageously by a round tube along the circumference of the jumper tube. Hence, a contact of the jumper tube with the surface of the cavity wall is prevented minimising a heat transfer to the aerofoil. The jumper tube may be arranged coaxially with a cavity axis or it may be arranged off centre in respect to the axis. In other words, as long as the minimum distance is exceeded the distance between the aerofoil wall and the jumper tube does not have to be equal around its circumference.

In an advantageous embodiment the cooling medium enters the gap through at least one aperture in the jumper tube, providing easy exit. Furthermore, the cooling medium exits the gap through at least one aperture in the cavity wall of the aerofoil and/or at through least one aperture in the inner platform. Consequently, the discharged cooling medium can be directed away from the disc region to be cooled by the main cooling flow through the jumper tube.

According to a further realisation of the invention the at least one aperture of the jumper tube and the at least one aperture of the cavity wall and/or the inner platform are oriented in such a way that the cooling medium enters the gap and exits the gap with different directions. This ensures that the flow of cooling medium flows in span wise direction as well as around the jumper tube or specifically in circumferential direction of the gap.

A homogeneous distribution of the cooling medium in the gap can be provided, when the orientation of the at least one aperture of the jumper tube and the at least one aperture of the cavity wall and/or the inner platform are opposed to one another.

The present invention further relates to a turbine assembly embodied in such a way to perform the inventive method.

Hence, the turbine assembly comprising a basically hollow aerofoil with at least one cavity spanning the aerofoil in span wise direction of the aerofoil, an outer platform and an inner platform, each advantageously comprising at least one wall segment being arranged basically perpendicular to the span wise direction and at opposite ends of the aerofoil, and wherein the outer platform and the inner platform each comprises at least one cavity, which are in flow communication with each other over at least one jumper tube, which extends in span wise direction along a whole length of the cavity of the aerofoil, and with a basically sealed gap being arranged between an outer surface of the jumper tube and an inner surface of a cavity wall of the aerofoil.

It is provided that the jumper tube comprises at least one aperture arranged directly adjacent to the outer platform, advantageously directly adjacent to the wall segment of the outer platform, to allow a fraction of the cooling medium access into the gap between the jumper tube and the cavity wall of the aerofoil and wherein the cavity wall of the aerofoil and/or the inner platform, advantageously the wall segment of the inner platform, comprises at least one aperture arranged directly adjacent to and/or in the inner platform, advantageously the aperture of the cavity wall of the aerofoil is directly adjacent to the wall segment of the inner platform and/or in the wall segment of the inner platform, to allow the cooling medium to exit from the gap between the jumper tube and the cavity wall of the aerofoil and wherein the jumper tube is free of holes in span wise direction to allow a basically unhindered and straight flow of cooling medium in span wise direction along the gap and/or the jumper tube is free of holes in span wise direction from a horizontal axis of the aperture of the jumper tube to the aperture at and/or in the outer platform, advantageously in the wall segment of the inner platform, and/or in the cavity wall of the aerofoil.

Due to the inventive matter an excessive heat pickup in comparison with a standard design of the jumper tube especially by low jumper tube flow rates can be avoided. The invention is a simple modification to the standard design, thus saving costs and construction efforts. Further, an existing design may be retrofitted easily. Although some cooling flow is used to buffer the air gap cavity, the amount is only a fraction of that required to reduce the heat pickup of the standard design when excessive flow through the jumper tube is used to compensate.

In another embodiment of the invention the gap between the jumper tube and the cavity wall of the aerofoil is a buffer cavity for the cooling flow of cooling medium in span wise direction providing an insulator between the jumper tube and the cavity wall of the aerofoil. Thus, the heat transfer between the jumper tube and the aerofoil can be advantageously minimised.

Beneficially, the gap arranged between the outer surface of the jumper tube and the inner surface of the cavity wall of the aerofoil of the turbine assembly extends all around an outer contour, advantageously the circumference, of the jumper tube. Hence, a contact of the jumper tube with the surface of the cavity wall is prevented minimising a heat transfer to the aerofoil.

To minimise disturbances of the unhindered and straight flow of cooling medium in span wise direction along the gap the cavity wall of the aerofoil is free of holes in span wise direction along the whole span wise length of the gap. In other words, the cavity wall of the aerofoil is free of holes from its beginning at the outer platform, advantageously from the wall segment of the outer platform, to its end at and/or in the inner platform. Naturally, the aperture through which the cooling flow exits the gap is an exception.

According to a further embodiment of the invention the jumper tube comprises a plurality of apertures arranged in flow direction of the cooling medium at a radial beginning of the gap, advantageously directly adjacent to the outer platform e.g. directly adjacent to the wall segment of the outer platform. As a result the cooling medium enters the gap at several positions maximising the insulating effect of the cooling medium in span wise direction. Advantageously, these apertures are arranged basically on the same horizontal height of the jumper tube, reducing possible turbulences in the gap.

Furthermore, a plurality of apertures are arranged in flow direction of the cooling medium at a radial end of the gap, advantageously in and/or at the inner platform, and especially in the cavity wall of the aerofoil and/or directly adjacent to the inner platform and/or in the wall segment of the inner platform. This prevents a back pressure of cooling medium and allows a quick exit. Advantageously, these apertures are arranged basically on the same horizontal height, advantageously of the cavity wall of the aerofoil or of the inner platform or its wall segment, respectively, preventing flow changes at different circumferential positions in the gap.

In this context "basically on the same horizontal height" should be understood as being arranged on an axis extending perpendicular to the span wise direction and/or in parallel to the wall segments of the platforms. Moreover, it should be understood in such a way that one aperture or a group of apertures differ in its/their radial position from another aperture or group of apertures maximal about a radial extension of one aperture. The apertures are advantageously spaced equally apart along the counter or specifically the circumference of the jumper tube or the aerofoil wall, respectively, resulting in less pressure fluctuation. Advantageously, the number of apertures on both ends of gap is the same.

In a further realisation of the invention it is provided that the aperture of the jumper tube and the aperture at and/or in the inner platform, preferably in the cavity wall of the aerofoil and/or in the side wall of the inner platform, direct the cooling flow of the cooling medium in different directions. This ensures that the flow of cooling medium flows in span wise direction as well as around the jumper tube or specifically in circumferential direction of the gap.

The aerofoil comprises a suction side and a pressure side and wherein the aperture at the outer platform and/or the aperture in the jumper tube directs the cooling flow of the cooling medium in direction of the suction side and/or wherein the aperture at and/or in the inner platform, advantageously in the cavity wall of the aerofoil and/or in the wall segment of the inner platform, directs the cooling flow of the cooling medium in direction of the pressure side. Consequently, the cooling medium exits the aerofoil at the pressure side. Due to this, the cooling flow will exit at a location of the aerofoil where the highest heat transfer will be present. This is caused by the so-called secondary flow effect where the main gas flow passing between the adjacent aerofoils also rotates, moving along the wall of one aerofoil to the opposite aerofoil. Moreover, since an aerofoil surface at the pressure side has a larger region it is able to discard the flow with less aerodynamic loss. In turn, a suction side flow must be discarded towards the leading edge before the throat region.

The apertures can be easily manufactured when the aperture of the jumper tube and the aperture at and/or in the inner platform, advantageously in the cavity wall of the aerofoil and/or in the wall segment of the inner platform, have a circular shape. Generally, the apertures may have any shape suitable for a person skilled in the art, like triangular, rectangular or oval.

As stated above, the aerofoil comprises a leading edge and a trailing edge. A sufficient flow of cooling medium for the cooling of the disc region can be provided, when the jumper tube is arranged near the leading edge. Since, the leading edge has a relatively large cross section in comparison with other regions of the aerofoil, a low pressure drop can be provided in the jumper tube. This results in a low velocity of the cooling medium traveling the jumper tube. Furthermore, the low velocity creates low convective heat transfer inside the jumper tube, helping to minimise the heat pick up.

In a further advantageous embodiment the aerofoil is a turbine blade or vane, and especially a nozzle guide vane.

The invention further provides a jumper tube with at least one aperture at one end, wherein the dimensions of the jumper tube are selected in such a way that the aperture is positioned directly adjacent or near the outer platform or its wall segment, respectively, when mounted in the cavity of the aerofoil.

The above-described characteristics, features and advantages of this invention and the manner in which they are achieved are clear and clearly understood in connection with the following description of exemplary embodiments which are explained in connection with the drawings.

BRIEF DESCRIPTION OF THE DRAWINGS

The present invention will be described with reference to drawings in which.

DETAILED DESCRIPTION OF THE ILLUSTRATED EMBODIMENTS

In the present description, reference will only be made to a vane, for the sake of simplicity, but it is to be understood that the invention is applicable to both blades and vanes of a turbine engine. The terms upstream and downstream refer to the flow direction of the airflow and/or working gas flow through the engine 60 unless otherwise stated. If used, the terms axial, radial and circumferential are made with reference to a rotational axis 70 of the engine 60.

Figure 1:
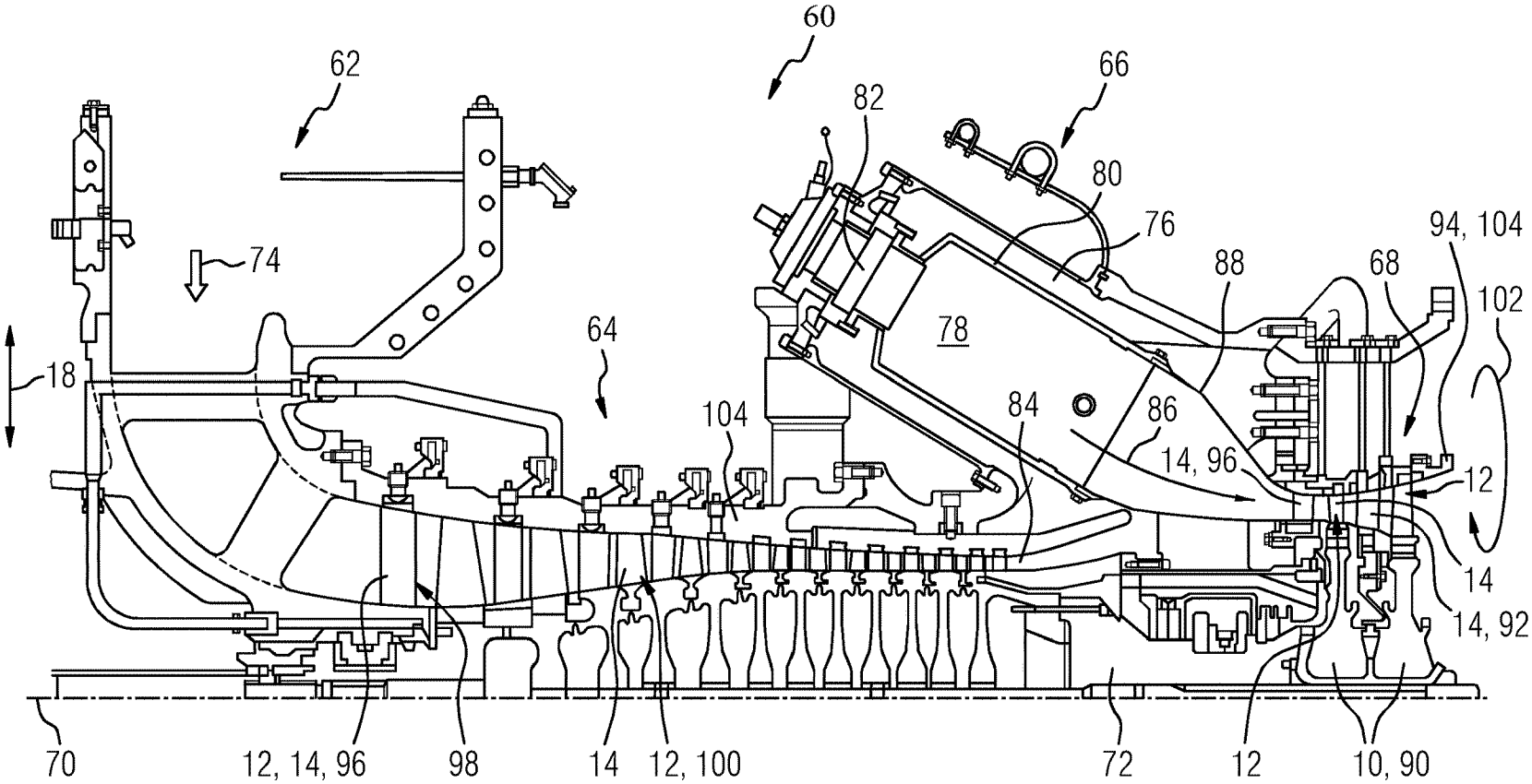
FIG. 1: shows a schematically and sectional view of a gas turbine engine comprising several inventive turbine assemblies.

FIG. 1 shows an example of a gas turbine engine 60 in a sectional view. The gas turbine engine 60 comprises, in flow series, an inlet 62, a compressor section 64, a combustion section 66 and a turbine section 68, which are generally arranged in flow series and generally in the direction of a longitudinal or rotational axis 70. The gas turbine engine 60 further comprises a shaft 72 which is rotatable about the rotational axis 70 and which extends longitudinally through the gas turbine engine 60. The shaft 72 drivingly connects the turbine section 68 to the compressor section 64.

In operation of the gas turbine engine 60, air 74, which is taken in through the air inlet 62 is compressed by the compressor section 64 and delivered to the combustion section or burner section 66. The burner section 66 comprises a burner plenum 76, one or more combustion chambers 78 defined by a double wall can 80 and at least one burner 82 fixed to each combustion chamber 78. The combustion chambers 78 and the burners 82 are located inside the burner plenum 76. The compressed air passing through the compressor section 64 enters a diffuser 84 and is discharged from the diffuser 84 into the burner plenum 76 from where a portion of the air enters the burner 82 and is mixed with a gaseous or liquid fuel. The air/fuel mixture is then burned and the combustion gas 86 or working gas from the combustion is channelled via a transition duct 88 to the turbine section 68.

The turbine section 68 comprises a number of blade carrying discs 90 or turbine wheels attached to the shaft 72. In the present example, the turbine section 68 comprises two discs 90 each carry an annular array of turbine assemblies 12, which each comprises an aerofoil 14 embodied as a turbine blade. However, the number of blade carrying discs 90 could be different, i.e. only one disc 90 or more than two discs 90. In addition, turbine cascades 92 are disposed between the turbine blades. Each turbine cascade 92 carries an annular array of turbine assemblies 12, which each comprises an aerofoil 14 in the form of guiding vanes, which are fixed to a stator 94 of the gas turbine engine 60. Between the exit of the combustion chamber 78 and the leading turbine blades inlet guiding vanes or nozzle guide vanes 96 are provided.

The combustion gas 86 from the combustion chamber 78 enters the turbine section 68 and drives the turbine blades which in turn rotate the shaft 72. The guiding vanes 96 serve to optimise the angle of the combustion or working gas 86 on to the turbine blades. The compressor section 64 comprises an axial series of guide vane stages 98 and rotor blade stages 100 with turbine assemblies 12 comprising aerofoils 14 or turbine blades or vanes 96, respectively. In circumferential direction 102 around the turbine assemblies 12 the turbine engine 60 comprises a stationary casing 104.

Figure 2:
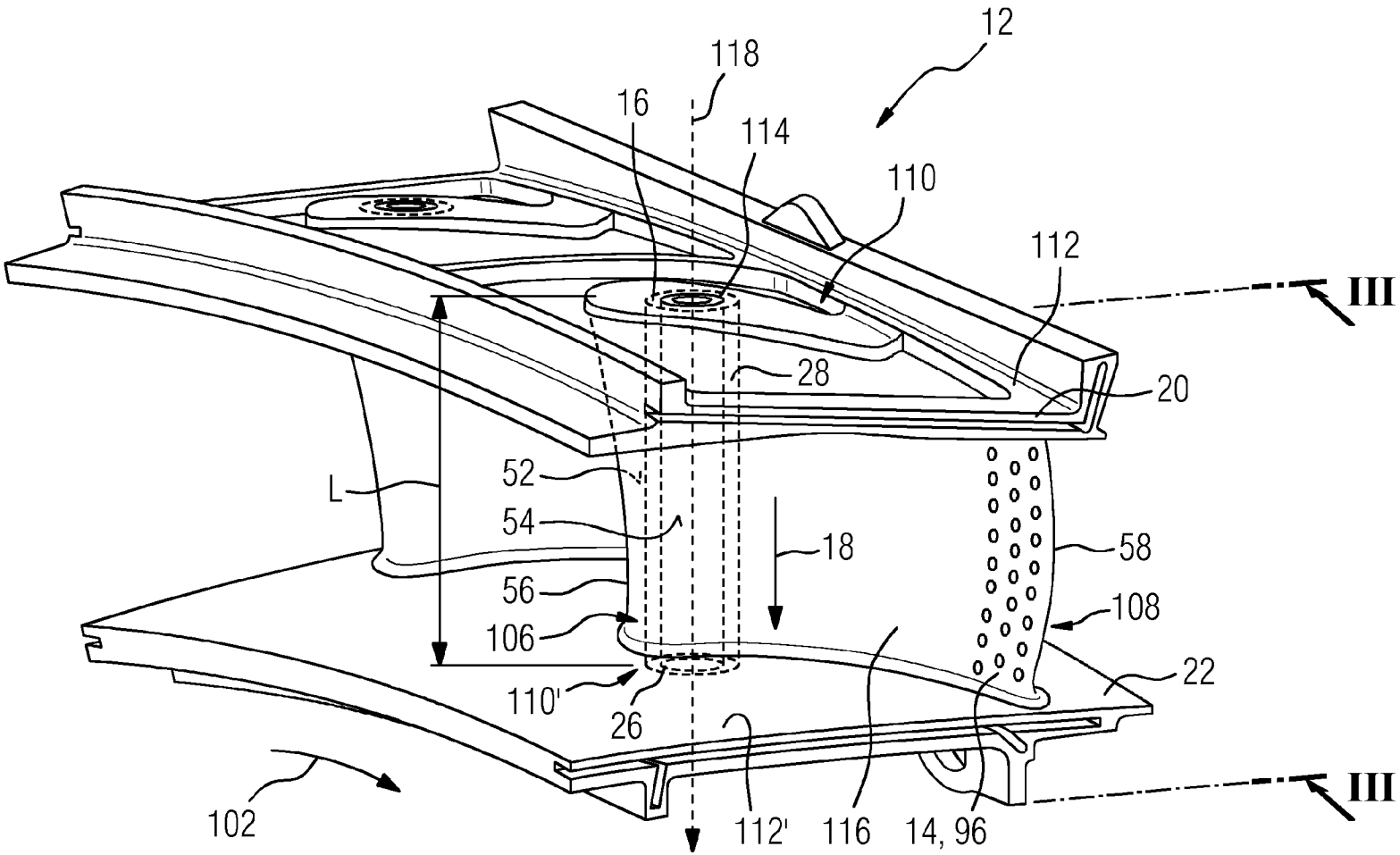
FIG. 2: shows a perspective view of a turbine assembly with a jumper tube inserted into an aerofoil of the gas turbine engine of FIG. 1, FIG. 3: shows a cross section through the turbine assembly along line III-III in FIG. 2, FIG. 4: shows a cross section along line IV-IV in FIG. 3 depicting an aperture in the jumper tube from FIG. 2.

FIG. 2 shows in a perspective view a turbine assembly 12 of the gas turbine engine 60. The turbine assembly 12 comprises a basically hollow aerofoil 14, embodied as a nozzle guide vane 96, with two cooling regions, specifically, an jumper cooling region 106 and a fin-pin/pedestal cooling region 108. The former is located at a leading edge 56 and the latter at a trailing edge 58 of the aerofoil 14. At opposed ends 110, 110' of the aerofoil 14 an outer platform 20 and an inner platform 22 are arranged. The outer and the inner platform 20, 22 both comprise a wall segment 112, 112' which are oriented basically perpendicular to a span wise direction 18 of the aerofoil 14. Each wall segment 112, 112' has an insertion aperture 114 which provides access to the aerofoil 14 (only the insertion aperture of wall segment 112 could be seen in FIG. 3). In a circumferential direction 102 of a not shown turbine wheel several aerofoils 14 could be arranged, wherein all aerofoils 14 where connected through the inner and the outer platforms 20, 22 with one another.

A casing 116 of the aerofoil 14 comprises or forms a cavity 16 spanning the aerofoil 14 in span wise direction 18, wherein the cavity 16 is located in the region of the leading edge 56. Via the insertion aperture 114 is a jumper tube 26 inserted inside the cavity 16 for cooling purpose.

Figure 3:
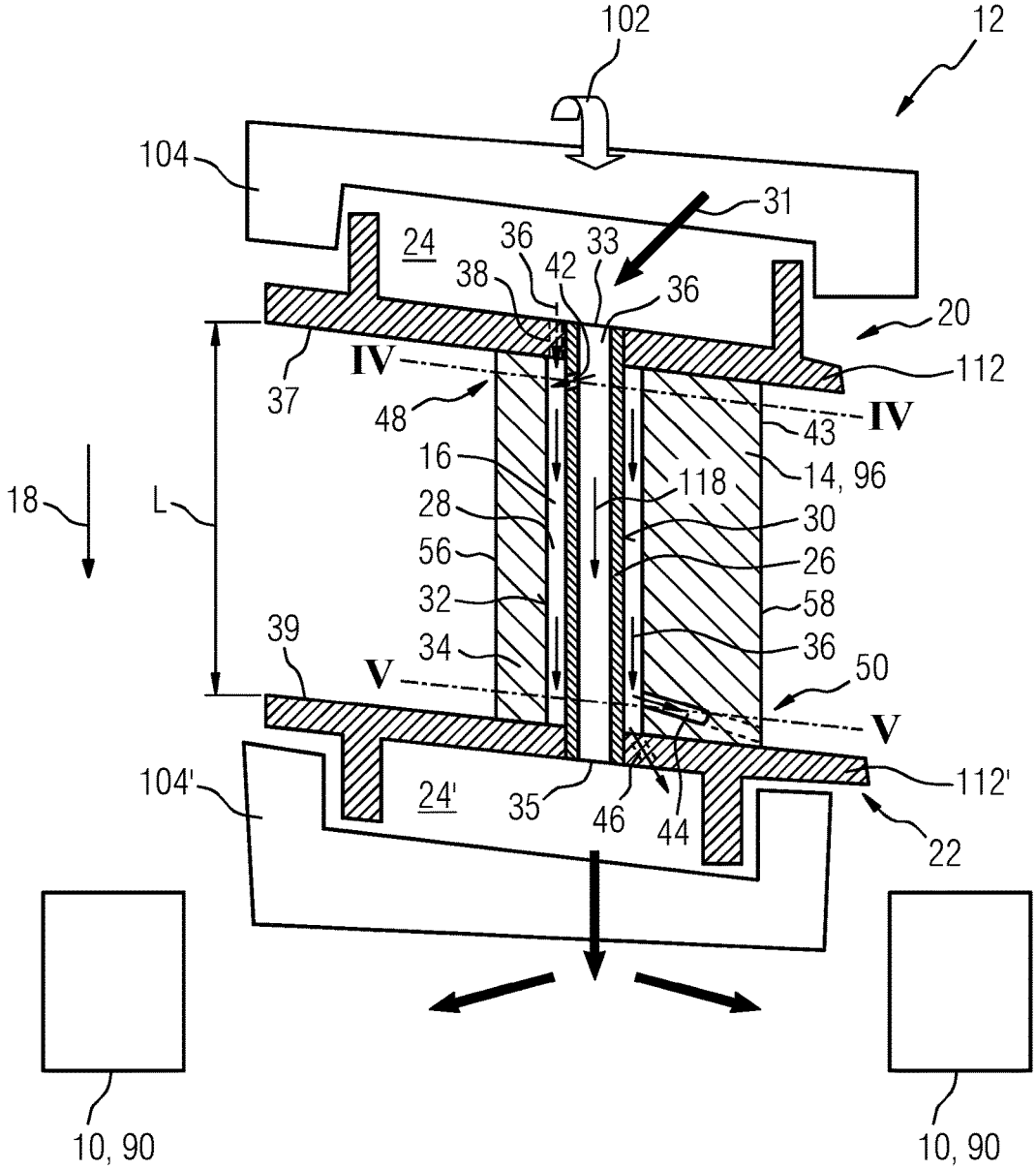

As could be seen in FIG. 3 that shows a cross section of the turbine assembly 12 along line III-III in FIG. 2, the outer platform 20 and the inner platform 22 each comprises at least one cavity 24, 24'. This cavity 24, 24' either extends between the wall segment 112 of the outer platform 20 and the outer casing 104 of the gas turbine engine 60 or the wall segment 112' of the inner platform 22 and an inner casing 104' of the gas turbine engine 60. Moreover, the cavities 24, 24' are in flow communication with each other over the jumper tube 26.

The jumper tube 26 extends in span wise direction 18 along a whole length L of the aerofoil 14 and in this example through wall segments 112, 112' of the outer and inner platforms 20, 20'. The length L is from an outer surface 37 or the outer platform 20 to the outer surface 39 of the inner platform 22. Further, during an operation of the turbine assembly 12 the jumper tube 26 provides a flow path for a flow of the fraction 36 of a cooling medium 31, like air 74, from the cavity 24 of the outer platform 20 to the cavity 24' of the inner platform 22 where the cooling medium exits into the gas path to cool a part 10 of a aerofoil assembly, like a disc 90 in a disc region of adjacently arranged turbine blades (not shown in detail).

The jumper tube 26 is arranged in the cavity 16 of the aerofoil 14 in such a way that a basically sealed gap 28 is arranged between an outer surface 30 of the jumper tube 26 and an inner surface 32 of a cavity wall 34 of the aerofoil 14. The gap 28 extends all around an outer contour 40 or in circumferential direction 102 of the jumper tube 26 (see also FIGS. 4 and 5). Thus, the cooling medium flows unhindered in the gap 28 all around the outer contour 40 of the jumper tube 26.

The jumper tube has a main inlet 33 and a main outlet 35 for a main part 118 of a cooling medium 31 to flow through. The jumper tube has at least one inlet aperture 42, 38 located within 0.2 L, i.e. 20% of the length L, of one of the inner and outer platforms 20, 22. The inlet aperture 38 is defined in the wall segment 112, 112' of the platform 20, 24 and connects the cavity 24, 24' directly to the gap 28. The turbine assembly may have either the inlet aperture(s) in the jumper tube or in the platform; alternatively there may be at least two inlet apertures in both the jumper tube and the platform.

The turbine assembly further has at least one outlet aperture 44, 46 located within 0.2 L, i.e. 20% of the length L, of the other inner and outer platforms 20, 22 for passing a fraction 36 of the cooling medium 31 through the gap 28. In particular the inlet passage 42 and/or the at least one outlet aperture 44, 46 are located within 0.1 L of their respective inner or outer platforms 20, 22. The intersection between aerofoil and platform can be particularly hot and therefore placing the inlet aperture 42 and/or the at least one outlet aperture 44, 46 may be located within 0.05 L of their respective inner or outer platforms 20, 22 so that the gap is fully ventilated and the main flow through the jumper tube is well insulated.

To prevent stagnant zones of the fraction of cooling flow in the gap, the at least one inlet passage 42 and/or the at least one outlet passage 44, 46 are angled in the direction from the main inlet 33 to the main outlet 35.

It should be appreciated that the inlet aperture(s) 42, 38 and outlet aperture(s) 44, 46 should be located where there is a positive pressure to drive the fraction 36 of cooling medium through the gap 28.

The jumper tube 26 comprises an aperture 42 arranged in flow direction of the cooling medium at a radial beginning 48 of the gap 28 or directly adjacent to the wall segment 112 of the outer platform 20. This allows a fraction 36 of the cooling medium access into the gap 28. Further, to allow the cooling medium to exit from the gap 28 the cavity wall 34 of the aerofoil 14 comprises an aperture 44 arranged in flow direction of the cooling medium at a radial end 50 of the gap 28 or directly adjacent to the inner platform 22 or its wall segment 112'. The aperture 42 of the jumper tube 26 and the aperture 44 in the cavity wall 34 have a circular shape (not shown in detail).

Alternatively or additionally, the wall segment 112' of the inner platform 22 may comprise an aperture 46, what is shown in dashed lines in FIG. 3.

From a radial inner end of the aperture 42 (or a horizontal axis of the aperture 42) to the radial outer end of the aperture 44 the jumper tube 26 is free of further holes to allow a basically unhindered and straight flow of cooling medium in span wise direction 18 along the gap 28.

Figure 4:
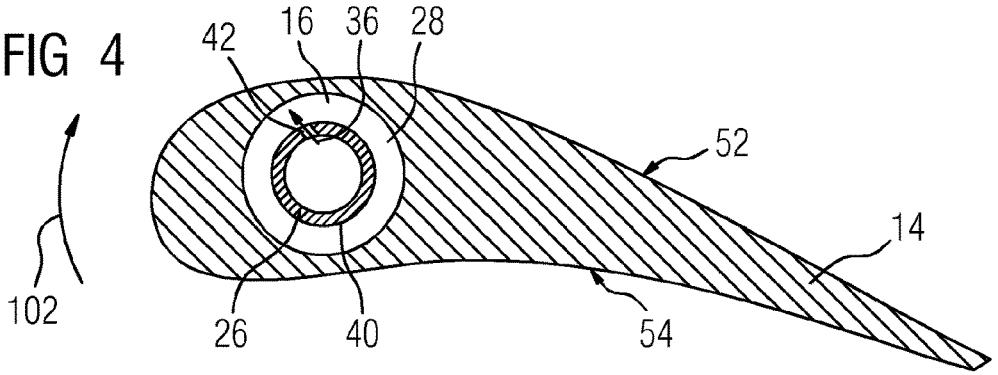
Figure 5:
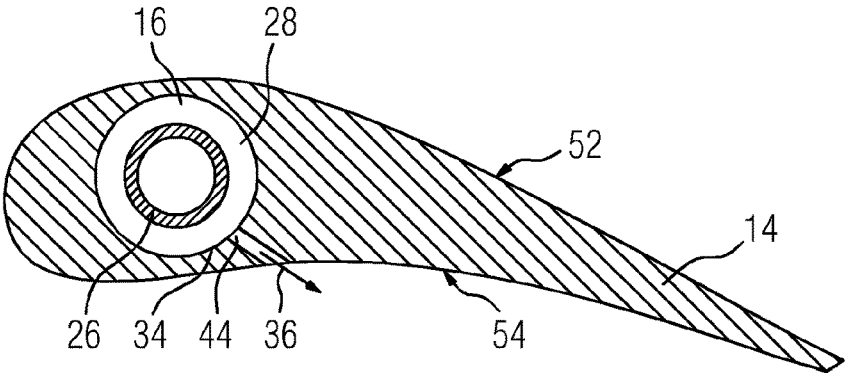
FIG. 5 shows a cross section along line V-V in FIG. 3 depicting an aperture in a cavity wall of an aerofoil of the turbine assembly from FIG. 2, FIG. 6: shows schematically an alternative orientation of the aperture in the jumper tube from FIG. 4, FIG. 7: shows schematically an alternative orientation of the aperture in the cavity wall of an alternative aerofoil.

The positioning of aperture 42 of the jumper tube 26 can be seen in FIG. 4 that shows a cross section along line IV-IV in FIG. 3. The aperture 42 directs the cooling flow of the cooling medium in direction of a suction side 52 of the aerofoil 14. Further, the positioning of aperture 44 in the cavity wall 34 can be seen in FIG. 5 that shows a cross section along line V-V in FIG. 3. The aperture 44 in the cavity wall 34 directs the cooling flow of the cooling medium in direction of a pressure side 54 of the aerofoil 14. Hence, the aperture 42 of the jumper tube 26 and the aperture 44 of the cavity wall 34 direct the cooling flow of the cooling medium in different directions.

The method for cooling the part 10, specifically the disc 90 of a turbine assembly 12 with the cooling medium will be explained in the following text with respect to FIG. 3.

Cooling medium flows from the cavity 24 of the outer platform 20 into the jumper tube 26. A fraction 36 of the cooling medium exits the jumper tube 26 through the aperture 42 and enters the gap 28 at its radial beginning 48 or adjacent to the wall section 112 of the outer platform 20. Inside the gap 28 the cooling medium travels in span wise direction 18 along the gap 28 basically unhindered and straight. Due to the circumferential extension of the gap 28 around the jumper tube 26 the cooling medium is also distributed in circumferential direction 102 along the gap 28. However, the general direction is still the flow in span wise direction 18 from the outer platform 20 in direction to the inner platform 22. At the radial end 50 of the gap 28 or adjacent of the inner platform 22 the cooling medium exits the gap 28 through the aperture 44 in the cavity wall 34 of the aerofoil 14 to be exhausted into a flow path of a flow medium of the gas turbine engine 60.

The in span wise direction 18 along the gap 28 established cooling flow 36 of the cooling medium provides an insulation for the jumper tube 26 to prevent a heat transfer between the jumper tube 26 and the cavity wall 34 of the aerofoil 14. Advantageously, the aperture 42 of the jumper tube 26 and the aperture 44 of the cavity wall 34 of the aerofoil 14 are positioned in such a way, that at least 80%, advantageously at least 90% and most advantageously at least 95% of a span wise length L of the gap 28 are travelled by the cooling medium.

A main fraction 118 of cooling medium travels an interior of the jumper tube 26 along a whole span of the aerofoil 14 and exits into the cavity 24' of the inner platform 22. From there it is exhausted in such a way that it cools the disc 90 of up- and downstream arranged discs 90 of adjacent turbine wheels.

Thus the method of operating the turbine assembly comprises the step of directing up to 20% of the cooling medium 31, that is the total amount of cooling fluid entering the main inlet 33, through the at least one inlet aperture 42 and into the gap 28. However, in most operational circumstances the inlet aperture 42 will be sized and arranged to allow between 5 and 10% of the cooling medium 31 through the at least one inlet aperture 42 and into the gap 28. Therefore, at least 80% of the cooling medium 31 is directed through the jumper tube, i.e. arrow 118 in FIG. 3, although advantageously 90-95% of the cooling medium 31 is passed through the jumper tube.

The method may comprise the step of exhausting the fraction 36 of the cooling medium 31 over an outer surface 43 of the aerofoil and/or an outer surface 37, 39 of the platform(s) 112, 112'. Here the fraction 36 of the cooling medium can form a cooling film over the outer surfaces to additionally cool particularly hot areas of the gas flow path. Furthermore, some of the energy of the fraction 36 of the cooling medium can be returned to the working gas flow.

The method may further comprise the step of exhausting the fraction 36 of the cooling medium 31 into the platform cavity 24, 24' of the outer platform 20 or inner platform 22. Exhausting the fraction 36 into the cavity 24, 24' may be done solely or in combination with exhausting the fraction 36 over an outer surface of the aerofoil and/or platform 37, 39.

In FIGS. 6 to 15 alternative embodiments of the orientation of the apertures 42, 44 and shapes of the aerofoil cavity 34 as well as of the jumper tube 26 are shown. Components, features and functions that remain identical are in principle substantially denoted by the same reference characters. To distinguish between the embodiments, however, the letter "a" to "g" has been added to the different reference characters of the embodiment in FIG. 5. The following description is confined substantially to the differences from the embodiment in FIGS. 1 to 5, wherein with regard to components, features and functions that remain identical reference may be made to the description of the embodiment in FIGS. 1 to 5.

Figure 6:
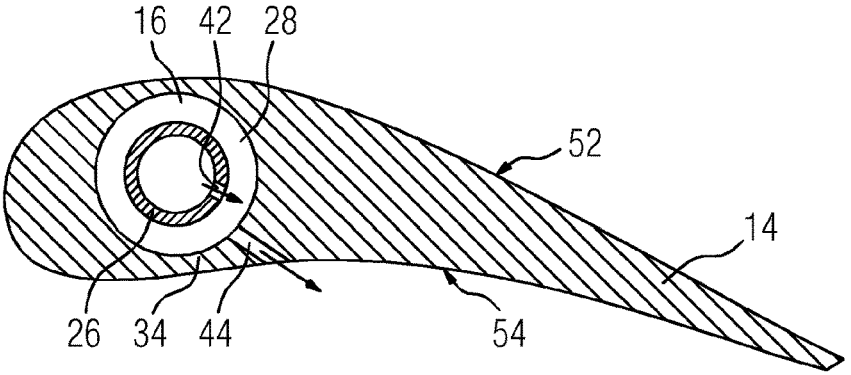

FIG. 6 shows in a merged view the cross sectional positions of the aperture 42 in the jumper tube 26 and of the aperture 44 in the cavity wall 34 of the aerofoil 14 from FIGS. 1 to 5. In this FIG and in the respective following FIG this merged view shows the cross sections along lines IV-IV and V-V of FIG. 3 in an artificial plane, that does not represent a real plane of the respective aerofoil. The embodiment from FIG. 6 differs in regard to the embodiment according to FIGS. 1 to 5 in that both apertures 42, 44 are oriented towards the pressure side 54 of the aerofoil 14. The jumper tube 26 may be the same as shown in FIGS. 1 to 5 but rotated in its position.

Figure 7:
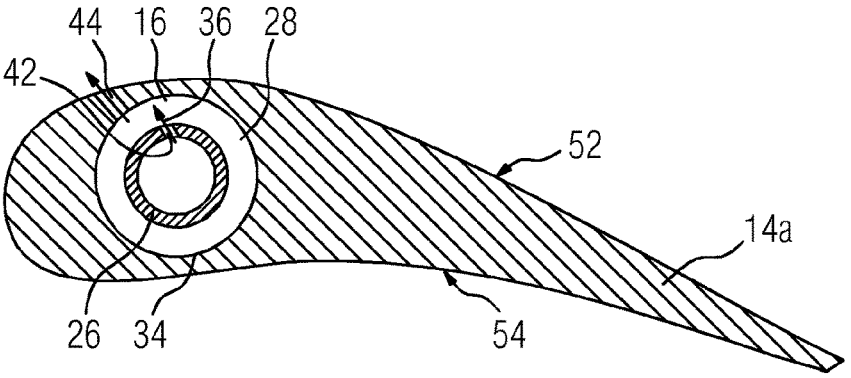

FIG. 7 shows in a merged view the cross sectional positions of the aperture 42 in the jumper tube 26 and of the aperture 44 in the cavity wall 34 of an alternatively embodied aerofoil 14*a*. The embodiment from FIG. 7 differs in regard to the embodiment according to FIGS. 1 to 5 in that both apertures 42, 44 are oriented towards a suction side 52 of the aerofoil 14*a*.

The exemplary embodiments of the apertures 42, 44 shown in FIGS. 6 and 7 depict the apertures 42, 44 as slightly off set towards each other. However, a ventilation effect would be greater if apertures 42, 44 were facing approximately away from each other (not shown in detail) instead of as shown being nearly aligned. A misalignment of the apertures 42, 44, e.g. of about 45° (not shown in detail), is beneficial to enhance the flow circulation in the gap 28 creating a more uniform temperature distribution.

Figure 8:
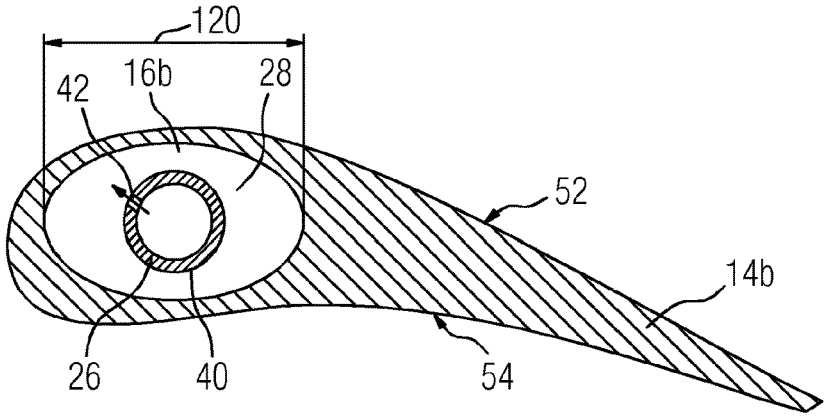
FIG. 8: shows schematically an alternatively embodied aerofoil with an oval cavity in a first orientation with the jumper tube from FIG. 4, FIG. 9: shows schematically an alternatively embodied aerofoil with an oval cavity in a second orientation with the jumper tube from FIG. 4, FIG. 10: shows schematically the aerofoil from FIG. 8 with two jumper tubes from FIG. 4 arranged in the oval cavity.
Figure 9:
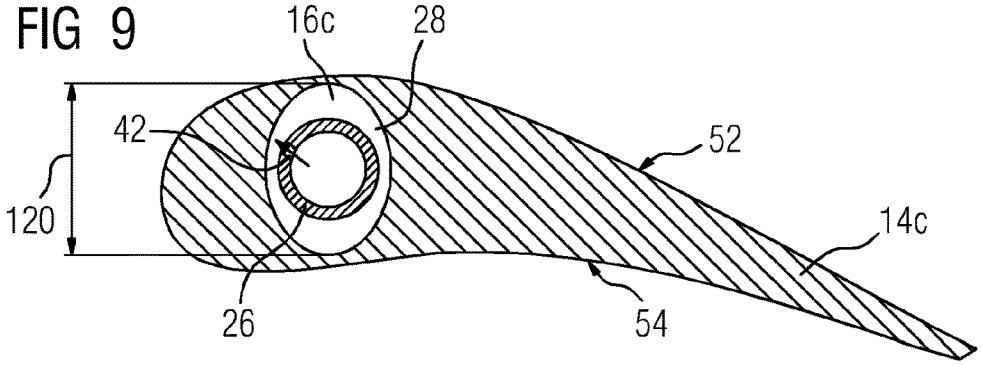

FIGS. 8 and 9 show cross sections of a second alternative aerofoil 14*b* and a third alternative aerofoil 14*c* depicted analogously to the cross section in FIG. 4 with a jumper tube 26 from FIGS. 1 to 5 positioned in the aerofoil 14*b*, 14*c*. The embodiment from FIGS. 8 and 9 differ in regard to the embodiment according to FIGS. 1 to 5 in that a cavity 16*b*, 16*c* of the aerofoil 14*b*, 14*c* has an oval shape. According to the embodiment in FIG. 8 the cavity 16*b* is oriented with its longer extension 120 perpendicular to a direction from a suction side 52 to a pressure side 54 of the aerofoil 14*b*. Whereas according to the embodiment in FIG. 9 the cavity 16*c* is oriented with its longer extension 120 in parallel to a direction from a suction side 52 to a pressure side 54 of the aerofoil 14*c*.

Figure 10:
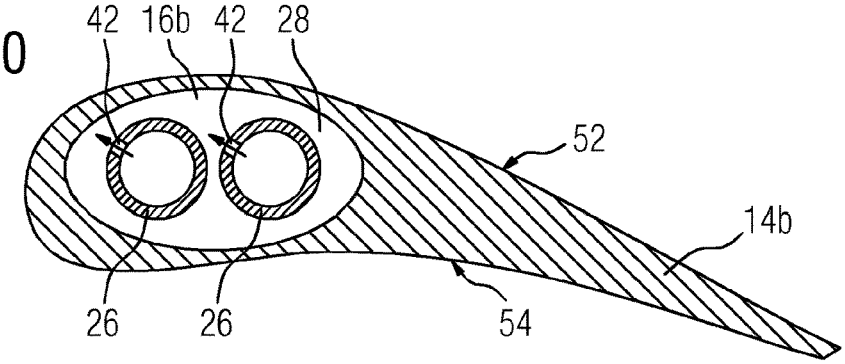

FIG. 10 shows a cross section of the aerofoil 14*b* from FIG. 8 depicted analogously to the cross section in FIG. 4. The embodiment from FIG. 10 differs in regard to the embodiment according to FIGS. 1 to 5 in that two jumper tubes 26 from FIGS. 1 to 5 are positioned in the aerofoil 14*b*.

Figure 11:
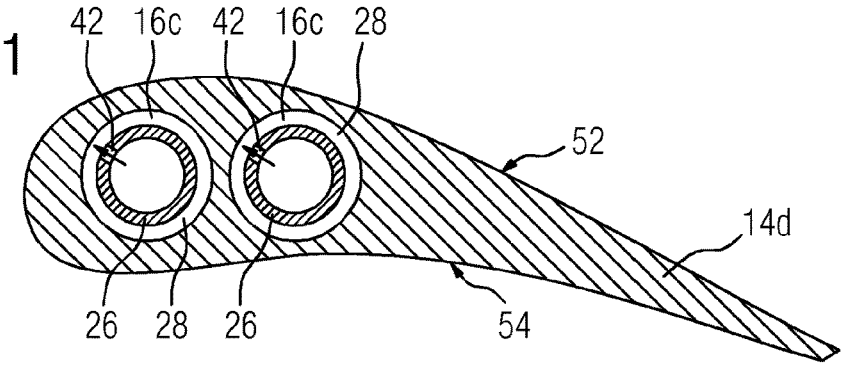
FIG. 11: shows schematically an alternatively embodied aerofoil with two oval cavities in the second orientation from FIG. 9 with a jumper tube from FIG. 4 arranged in each oval cavity.

FIG. 11 shows a cross section of a forth alternative aerofoil 14*d* depicted analogously to the cross section in FIG. 4. The embodiment from FIG. 11 differs in regard to the embodiment according to FIGS. 1 to 5 in that the aerofoil 14*d* comprises two oval cavities 16*c* from FIG. 9, wherein in each cavity 16*c* a jumper tube 26 from FIGS. 1 to 5 is positioned.

Figure 12:
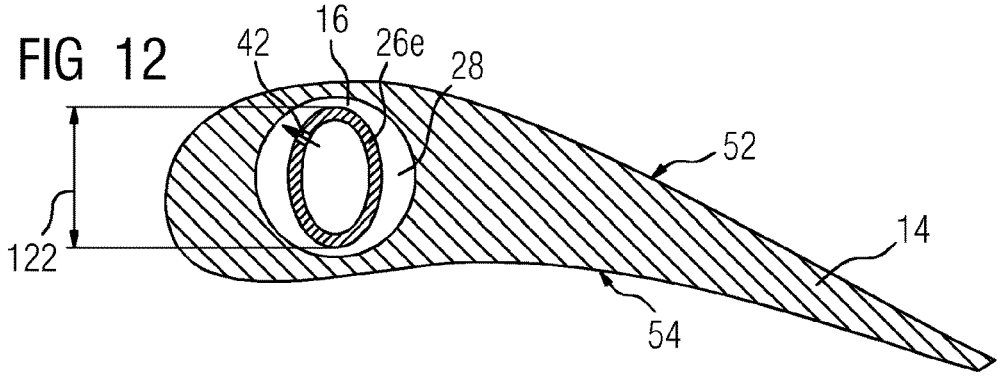
FIG. 12: shows schematically an alternatively embodied jumper tube in a first orientation.
Figure 13:
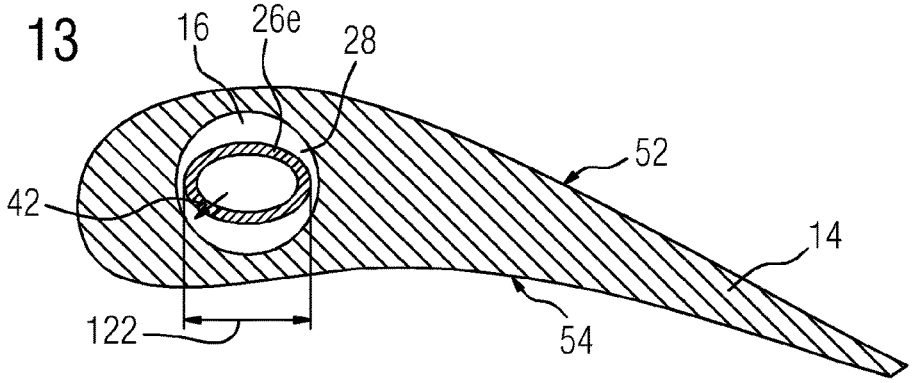
FIG. 13: shows schematically the jumper tube from FIG. 12 in a second orientation.

FIGS. 12 and 13 show cross sections of an alternative jumper tube 26*e* depicted analogously to the cross section in FIG. 4, wherein the jumper tube 26*e* is positioned in the aerofoil 14 from FIGS. 1 to 5. The embodiment from FIGS. 12 and 13 differ in regard to the embodiment according to FIGS. 1 to 5 in that the jumper tube 26*e* has an oval shape. According to the embodiment in FIG. 12 the jumper tube 26*e* is oriented with its longer extension 122 in parallel to a direction from the suction side 52 to the pressure side 54. Whereas according to the embodiment in FIG. 13 the jumper tube 26*e* is oriented with its longer extension 122 perpendicular to the direction from the suction side 52 to the pressure side 54.

Figure 14:
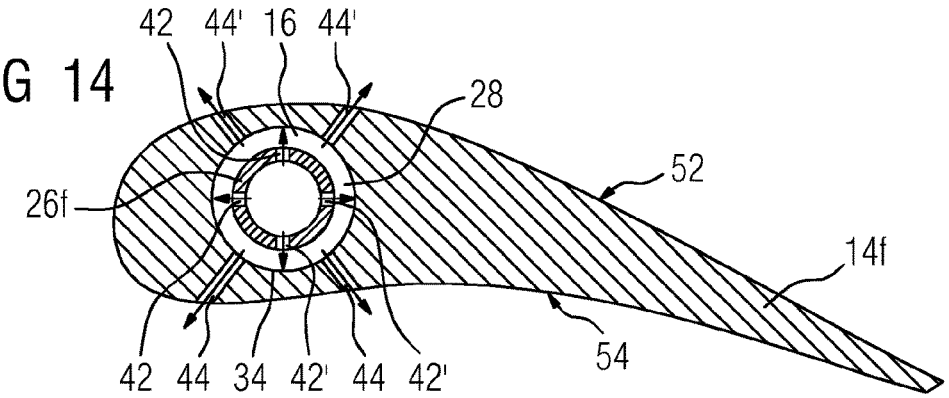
FIG. 14: shows schematically an alternatively embodied aerofoil with four exit apertures and an alternative jumper tube with four apertures

FIG. 14 shows in a merged view the cross sectional positions of apertures 42, 42' in an alternatively embodied jumper tube 26*f* and of apertures 44, 44' in a cavity wall 34 of an alternatively embodied aerofoil 14*f*. The embodiment from FIG. 14 differs in regard to the embodiment according to FIGS. 1 to 5 in that the jumper tube 26*f* as well as the aerofoil 14*f* comprise four apertures 42, 42', 44, 44'. These apertures 42, 42' are arranged basically on the same horizontal height of the jumper tube 26*f* or the apertures 44, 44' are arranged basically on the same horizontal height of the cavity wall 34 of the aerofoil 14*f*, respectively. Each horizontal height is the plane along the cross section IV-IV and V-V shown in FIG. 3.

To prevent a major communication between the suction side 52 and the pressure side 54 of the aerofoil 14*f* through apertures 44, 44' characteristics of the components had to be specifically adjusted and/or selected. For example to prevent the hot gas from the pressure side 54 entering the aerofoil 14*f* through apertures 44 and leave via apertures 44' a flow out from the jumper tube 26*f* has to be minimized. Selecting a different hole size (smaller) for apertures 44 compared to apertures 44' may have some impact but the area difference between apertures 42, 42' and 44, 44' together with the pressure drop across the wall of the jumper tube 26*f* and the pressure drop across the aerofoil wall 34 will be the dominating factors that must be selected with care in the design process.

Figure 15:
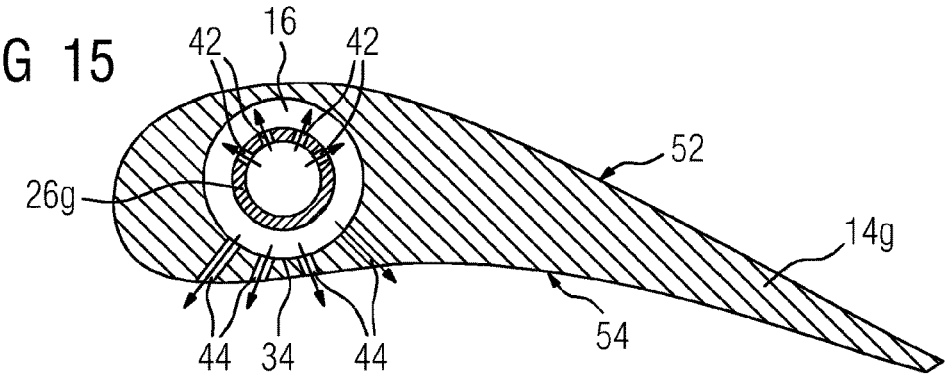
FIG. 15: shows schematically an alternatively embodied aerofoil with four exit apertures and an alternative jumper tube with four apertures.

The risk for a direct flow communication between the apertures 44' at the suction side 52 and the apertures 44 at the pressure side 54 of the embodiment of FIG. 14 can be minimized by the embodiment shown in FIG. 15. In FIG. 15 cross sectional positions of apertures 42 of an alternatively embodied jumper tube 26*g* and of apertures 44 in a cavity wall 34 of an alternatively embodied aerofoil 14*g* are shown in a merged view. The embodiment from FIG. 15 differs in regard to the embodiment according to FIGS. 1 to 5 in that the jumper tube 26*g* as well as the aerofoil 14*g* comprises four apertures 42, 44. These apertures 42 are arranged basically on the same horizontal height of the jumper tube 26*g* or the apertures 44 are arranged basically on the same horizontal height of the cavity wall 34 of the aerofoil 14*g*, respectively. Each horizontal height is the plane along the cross section IV-IV and V-V shown in FIG. 3. Moreover, all four apertures 42 direct the cooling flow of the cooling medium in direction of a suction side 52 of the aerofoil 14*g*. Further, all four aperture 44 in the cavity wall 34 directs the cooling flow of the cooling medium in direction of a pressure side 54 of the aerofoil 14*g*.

Generally, all shown orientations of the aperture(s) of the jumper tube(s) and the cavity wall of the aerofoil(s) can be combined with each shown cavity shape or orientation. Further, all shown features of the aperture(s) of the cavity wall of the aerofoil(s) may be additionally or alternatively embodied at the inner platform or its wall segment, respectively.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

Although the invention is illustrated and described in detail by the preferred embodiments, the invention is not limited by the examples disclosed, and other variations can be derived therefrom by a person skilled in the art without departing from the scope of the invention.

It is an important aspect of the present invention that there may be no apertures in the jumper tube outside the regions where the inlet aperture and outlet apertures are located. In other words the jumper tube only has apertures located within 0.2 L of one or both the inner and outer platforms 20, 22. There are no apertures in at least 0.6 L of the jumper tube, preferably there are no apertures in at least 0.8 L of the jumper tube and there are no apertures within at least 90% of the jumper tube.

Thus the jumper tube and turbine assembly disclosed herein are designed to convey relatively cool cooling medium across the hot working gas flow path without incurring significant heat pick-up. As described above the majority of the cooling medium passing into the jumper tube from one platform cavity 24 to the platform cavity 24' (or vice versa) is intended to cool engine components, such as a turbine disc, rather than this turbine assembly. This jumper tube and turbine assembly arrangement is in stark contrast to other component designs incorporating impingement tubes which use the majority of cooling medium to cool the component itself via impingement jets. In these designs little or no cooling medium is transferred across the working gas flow path.

What is claimed is:

1. A turbine assembly, comprising:

a hollow aerofoil formed by a cavity wall defining a cavity spanning the aerofoil in a span wise direction of the aerofoil, a first platform comprising a first platform cavity and a second platform comprising a second platform cavity, wherein the first platform cavity and the second platform cavity are in flow communication with each other through a jumper tube, which extends in the span wise direction along a span wise length (L) of the aerofoil, a gap between an outer surface of the jumper tube and an inner surface of the cavity wall, wherein the jumper tube comprises a main inlet and a main outlet, wherein the main outlet exhausts a first flow of cooling medium, and at least one inlet aperture to the gap located within 0.2 L of the first platform and configured to pass a second flow of cooling medium into the gap; and at least one outlet aperture located within 0.2 L of the second platform configured to exhaust an entirety of the second flow of cooling medium out of the gap, wherein the jumper tube is free of apertures between the at least one inlet aperture and the at least one outlet aperture, and wherein the first flow of cooling medium remains discrete from the second flow of cooling medium at least until the first flow of cooling medium enters the second platform cavity.

2. The turbine assembly according to claim 1, wherein the second flow of cooling medium flowing in the span wise direction in the gap provides an insulation for the jumper tube to prevent a heat transfer between the jumper tube and the cavity wall of the aerofoil.

3. The turbine assembly according to claim 1, wherein at least 80% of the span wise length of the aerofoil is traveled by the second flow of cooling medium.

4. The turbine assembly according to claim 3, wherein at least 90% of the span wise length of the aerofoil is travelled by the second flow of cooling medium.

5. The turbine assembly according to claim 3, wherein at least 95% of the span wise length of the aerofoil is travelled by the second flow of cooling medium.

6. The turbine assembly according to claim 1, wherein the jumper tube is arranged in the cavity of the aerofoil and wherein the gap extends all around an outer contour of the jumper tube.

7. The turbine assembly according to claim 1, wherein the at least one inlet aperture is formed in at least one of the jumper tube and the first platform and the at least one outlet aperture is formed in at least one of the cavity wall and the second platform.

8. The turbine assembly according to claim 1, wherein the at least one inlet aperture and the at least one outlet aperture are oriented in such a way that the second flow of cooling medium enters the gap in a first direction and exits the gap in a second direction that is different than the first direction.

9. The turbine assembly according to claim 1, wherein the at least one inlet aperture is located within 0.1 L of the first platform and the at least one outlet aperture is located within 0.1 L of the second platform.

10. The turbine assembly according to claim 1, wherein the at least one inlet aperture is located within 0.05 L of the first platform and the at least one outlet aperture are located within 0.05 L of the second platform.

11. The turbine assembly according to claim 1, wherein the at least one inlet aperture and/or the at least one outlet aperture are angled at least partly in a direction from the main inlet to the main outlet.

12. The turbine assembly according to claim 1, wherein the aerofoil is any one of a group consisting of a turbine blade, a turbine vane and a nozzle guide vane.

13. A method of operating the turbine assembly of claim 1, wherein the method comprises:

directing up to 20% of cooling medium entering the jumper tube through the at least one inlet aperture and into the gap to form the second flow of cooling medium.

14. The method according to claim 13, wherein the directing is between 5 and 10% of the cooling medium entering the jumper tube through the at least one inlet aperture and into the gap.

15. The method according to claim 13, further comprising:

directing at least 80% of the cooling medium entering the jumper tube through the jumper tube to form the first flow of cooling medium.

16. The method according to claim 13, further comprising:

exhausting the second flow of cooling medium from the at least one outlet aperture over at least one of an outer surface of the aerofoil and the second platform.

17. The method according to claim 13, further comprising: exhausting the second flow of cooling medium from the at least one outlet aperture into the second platform cavity of the second platform.

18. The turbine assembly according to claim 1, wherein the cavity wall is free of holes in the span wise direction along an entirety of the span wise length of the aerofoil.

19. The turbine assembly according to claim 1, wherein the at least one outlet aperture comprises a hole through the cavity wall, and wherein the cavity wall is otherwise free of holes in the span wise direction along an entirety of the span wise length of the aerofoil.

* * * * *